US007815491B2

(12) United States Patent
Feng et al.

(10) Patent No.: US 7,815,491 B2
(45) Date of Patent: Oct. 19, 2010

(54) POLISHING PAD, THE USE THEREOF AND THE METHOD FOR MANUFACTURING THE SAME

(75) Inventors: Chung-Chih Feng, Kaohsiung (TW); I-Peng Yao, Kaohsiung (TW); Lyang-Gung Wang, Kaohsiung (TW); Yung-Chang Hung, Kaohsiung (TW)

(73) Assignee: San Feng Chemical Industry Co., Ltd., Kaohsiung (TW)

( * ) Notice: Subject to any disclaimer, the term of this patent is extended or adjusted under 35 U.S.C. 154(b) by 296 days.

(21) Appl. No.: 11/754,418

(22) Filed: May 29, 2007

(65) Prior Publication Data

US 2008/0299879 A1 Dec. 4, 2008

(51) Int. Cl.
*B24B 1/00* (2006.01)
*B24D 11/00* (2006.01)

(52) U.S. Cl. ..... 451/41; 451/533; 451/536

(58) Field of Classification Search ..... 451/41, 451/532–534, 536, 526; 51/297, 298
See application file for complete search history.

(56) References Cited

U.S. PATENT DOCUMENTS

| | | | | |
|---|---|---|---|---|
| 5,041,517 | A * | 8/1991 | Vu et al. | 528/60 |
| 6,095,902 | A * | 8/2000 | Reinhardt | 451/36 |
| 6,623,337 | B2 * | 9/2003 | Scott et al. | 451/41 |
| 6,807,006 | B2 | 10/2004 | Nakagoshi | |
| 6,905,402 | B2 * | 6/2005 | Allison et al. | 451/533 |
| 6,929,534 | B2 * | 8/2005 | Miyazawa | 451/41 |
| 7,556,555 | B2 * | 7/2009 | Feng et al. | 451/41 |
| 2002/0081946 | A1 | 6/2002 | Scott et al. | |
| 2005/0070216 | A1 | 3/2005 | Roberts et al. | |
| 2006/0089095 | A1 * | 4/2006 | Swisher et al. | 451/533 |
| 2006/0199473 | A1 | 9/2006 | Suzuki et al. | |
| 2006/0254706 | A1 | 11/2006 | Swisher et al. | |

FOREIGN PATENT DOCUMENTS

| | | | |
|---|---|---|---|
| CN | 1738698 | A | 2/2006 |
| CN | 1768417 | A | 5/2006 |
| TW | 380078 | | 1/2000 |
| TW | 200536663 | A | 11/2005 |
| WO | 2004062849 | A1 | 7/2004 |

OTHER PUBLICATIONS

Office Action From Chinese Patent Patent Office Correspondingn to Chna (PRC) Patent Application No. 2007101523001 Dated Jun. 19, 2009.

Search report from corresponding ROC (Taiwan) Patent Application No. 096119161.

* cited by examiner

*Primary Examiner*—Maurina Rachuba
(74) *Attorney, Agent, or Firm*—Volentine & Whitt, PLLC

(57) ABSTRACT

The present invention mainly relates to a polishing pad comprising a base material comprising fibers; a membrane with low permeability; a two-component paste formed on the upper surface of the membrane with low permeability for adhering the base material to the membrane with low permeability; and a polyurethane paste formed on the lower surface of the membrane with low permeability. A method of polishing a substrate comprising using the polishing pad and a method for manufacturing the polishing pad as described above are also provided. The polishing pad as mentioned above prevents the polishing pad from detaching from the polishing platen or head. The polishing pad is easy to be replaced without leaving residues on the polishing platen or head.

16 Claims, No Drawings

POLISHING PAD, THE USE THEREOF AND THE METHOD FOR MANUFACTURING THE SAME

BACKGROUND OF THE INVENTION

1. Field of the Invention

The present invention relates to a polishing pad for use in chemical mechanical polishing.

2. Description of the Related Art

The chemical mechanical polishing (CMP) is a procedure for planarizing the surface of a substrate with a polishing pad. The CMP is generally applied in polishing lens, mirrors, substrates of liquid crystal displays, silicon wafers, and oxidation and/or metal layers on silicon wafers.

Taking silicon wafers as an example, ingots of monocrystalline silicon are sliced first. The wafers are usually lapped to make them flat for subsequently chemical etching. A polishing process is required after the etching process. During the polishing process, a polishing pad together with slurry reacts chemically with the silicon atoms on the surface of the wafer to make the reacted surface softer than the underlying silicon. Furthermore, the reacted surface is continually wiped away, causing fresh silicon to be exposed to the slurry and the polishing pad.

A conventional polishing pad comprises a base material comprising fibers. A polishing layer comprising a porous elastomer such as polyurethane is also provided on or in the base material. By using a pressure sensitive adhesive (PSA), the conventional polishing pads are secured to a polishing platen or head of a polishing machine. The pressure sensitive adhesive comprises a carrier film comprising polyester, for example, and has an adhesive with a low fluidity on an upper side and a lower side of the carrier film. Such an adhesive is known as the dual-sided adhesive. The adhesive on the upper side of the carrier film is configured to couple the base material of the polishing pad, and that on the lower side of the carrier film is to couple the polishing platen or head of the polishing machine.

Because the base material of the polishing pad comprises fibers, contents of the base material are not distributed evenly. The variations of the thickness of the base material are easily observed. Besides, the surface of the base material is not flat and is usually rough and undulant. Such features make the base material difficult to attach tightly and completely to the carry film of the PSA. On the other hand, the polishing platen or head of the polishing machine usually has a flat surface. It follows that the adhesion strength between the base material and the carrier film is weaker than that between the carrier film and the polishing platen or head of the polishing machine. Therefore, the polishing pad easily detaches from the polishing machine. Additionally, when the polishing pad is replaced, residues of the PSA are easily left behind on the polishing platen or head and the residues of the PSA need to be removed and the time needed for replacing polishing pad is lengthened. Furthermore, a thickness of the carrier film of about 0.1 mm is too thin, and a folding line easily occurs. On the other hand, the pH resistance of the conventional adhesive is not satisfactory. The effect and efficiency of the CMP are both reduced thereby.

SUMMARY OF THE INVENTION

One object of the present invention is to provide a polishing pad comprising:

a base material comprising fibers;

a membrane with low permeability, the membrane having an upper surface and a lower surface;

a two-component paste formed on the upper surface of the membrane with low permeability for adhering the base material to the membrane with low permeability; and a polyurethane paste formed on the lower surface of the membrane with low permeability.

Another object of the present invention is to provide a method of polishing a substrate comprising using the polishing pad as described above to polish a surface of the substrate.

Still another object of the present invention is to provide a method for manufacturing the polishing pad as mentioned above comprising steps of:

(a) applying the two-component paste on the upper surface of the membrane with low permeability;

(b) adhering the base material to the two-component paste; and (c) applying the polyurethane paste to the lower surface of the membrane with low permeability.

The polishing pad as mentioned above prevents the polishing pad from detaching from the polishing platen or head. The polishing pad is easy to be replaced without leaving residues on the polishing platen or head.

DETAILED DESCRIPTION OF THE INVENTION

The present invention is to provide a polishing pad comprising:

a base material comprising fibers;

a membrane with low permeability, the membrane having an upper surface and a lower surface;

a two-component paste formed on the upper surface of the membrane with low permeability for adhering the base material to the membrane with low permeability; and a polyurethane paste formed on the lower surface of the membrane with low permeability.

According to the invention, any base material comprising fibers can be applied in the invention. Preferably, the base material comprises a non-woven fabric, and more preferably, the base material comprises a rolled non-woven fabric. The rolled non-woven fabric can be used in a roll-to-roll way that improves batch uniformity in comparison with a conventional method of producing a single polishing pad involving molding or casting.

As used herein, "a non-woven fabric" refers to a manufactured sheet, web or mat of directionally or randomly orientated fibers, bonded by friction, and/or cohesion and/or adhesion, excluding paper and products which are woven, knitted, tufted, stitch-bonded incorporating binding yams or filaments, or felted by wet-milling, whether or not additionally needled. The fibers may be of natural or man-made origin. They may be staple or continuous filaments or be formed in situ. Depending on the method of forming the web, the non-woven fabric usually comprises a composite non-woven fabric, a needle-punched nonwoven fabric, a melt-blown non-woven fabric, a spun-bonded non-woven fabric, a dry-laid non-woven fabric, a wet-laid non-woven fabric, a stitch-bonded non-woven fabric, or a spunlace non-woven fabric. Compared with woven fabric, non-woven fabric has a better material property.

As used herein, the term "(a) fiber(s)" refers to a single fiber or composite fibers, preferably composite fibers. The fiber is selected in accordance with a substrate to be polished. The fibers of the base material provide protrusions for polishing and also provide a scaffold allowing elastomers of a polishing layer to be deposed in the space defined by the scaffold if necessary. Artisans skilled in this field can choose suitable kinds of fibers and coordinate the elastomers with the fibers according to the disclosure of the specification. Preferably, the fiber is made of at least one material selected from the group consisting of polyamide, terephthalamide, polyester, polymethyl methacrylate, polyethylene terephthalate, polyacrylonitrile, and a mixture thereof.

As used herein, the term "a membrane with low permeability" refers to a membrane or film that substantially prevents the paste on the upper surface of the membrane with low permeability according to the invention from permeating to the lower surface of the membrane with low permeability. Preferably, the material of the membrane with low permeability is selected from the group consisting of polyethylene terephthalate (PET), polypropylene (PP), polyethylene (PE), and a mixture thereof. Furthermore, the polypropylene is oriented polypropylene (OPP).

In one preferred embodiment of the invention, a thickness of the membrane with low permeability is from about 0.2 mm to about 0.3 mm. The thickness of the membrane with low permeability is thick enough to provide a satisfactory tenacity avoiding a folding line.

The two-component paste is formed on the upper surface of the membrane with low permeability for adhering the base material to the membrane with low permeability. Preferably, the two-component paste is embedded into the fibers of the base material. Because the two-component paste according to the invention is embedded into the fibers of the base material, it provides a strong adhesion strength between the base material and the membrane with low permeability.

The two-component paste according to the invention refers to the paste comprising two components that interact or cross-link with each other for achieving the adhesion effect. Preferably, the two-component paste comprises a polyol resin and polyisocyanate. More preferably, the polyol resin is polyurethane.

In another preferred embodiment of the invention, the two-component paste is pH resistant in a pH range from about 2 to about 13. The broad range of pH resistance is obtained by adjusting components in the two-component paste. For example, an acid or a base resistant component is chosen.

In one preferred embodiment of the invention, the two-component paste is temperature resistant in a temperature range from about 10° C. to about 200° C.

According to the invention, the polyurethane paste is formed on the lower surface of the membrane with low permeability. The polyurethane paste is used for attaching the polishing pad to a polishing platen or head of a polishing machine. Preferably, an adhesion strength between the base material and the membrane with low permeability provided by the two-component paste is stronger than that between the membrane with low permeability and the polishing platen or head of the polishing machine provided by the polyurethane past. Such design prevents the polishing pad from detaching from the polishing platen or head. The polishing pad is easy to be replaced without leaving residues on the polishing platen or head.

Preferably, the polishing pad according to the invention further comprises a second membrane with low permeability formed below the polyurethane paste. Preferably, the material of the second membrane with low permeability is selected from the group consisting of polyethylene terephthalate, polypropylene, and polyethylene, and a mixture thereof.

In one more preferred embodiment of the invention, the polishing pad further comprises second paste formed below the second membrane with low permeability for attaching the polishing pad to the polishing platen or head of the polishing machine. Preferably, the second paste comprises polyurethane.

In another preferred embodiment of the invention, the polishing pad further comprises a polishing layer on the base material comprising a porous elastomer. As used herein, the term "an elastomer," also known as "an elastic polymer," refers to a type of polymer that exhibits a rubber-like quality. When polishing, the elastomer serves as a good buffer to avoid scraping the surface of the substrate to be polished. In one preferred embodiment of the invention, the elastomer comprises a foam resin. As used herein, the term "a foam resin" refers to a material containing a thermoplastic resin and a thermodecomposing foaming agent. Preferably, the elastomer includes at least one selected from the group consisting of polyamide, polycarbonate, polyaminonitrile, polyinethacrylate, epoxyl resin, phenolic resins, polymethyl methacrylate, polyaminoester, vinylbenzene polymer, acrylic resin, polyurethane, and a mixture thereof. More preferably, the elastomer comprises polyurethane.

The present invention also provides a method of polishing a substrate comprising using the polishing pad as mentioned above to polish a surface of the substrate.

The present invention also provides a method for manufacturing the polishing pad as described above comprising steps of:

(a) applying the two-component paste on the upper surface of the membrane with low permeability;

(b) adhering the a base material to the two-component paste; and (c) applying the polyurethane paste to the lower surface of the membrane with low permeability.

In one preferred embodiment of the invention, the polyurethane paste is applied on a second membrane with low permeability before step (c).

In another preferred embodiment of the invention, a second paste is formed on the second membrane with low permeability.

The following examples are given for the purpose of illustration only and are not intended to limit the scope of the present invention.

Conventional polishing pad 1: A base material is secured to a polishing platen with pressure sensitive adhesive (dual-sided adhesive, TOYO INK®, BPS-3156D) having a polyethylene terephthalate membrane.

Polishing pad 2 according to the invention: A base material is adhered to a first polyethylene terephthalate membrane with two-component paste (HOME MAOW®, 5101). The first Polyurethane paste is formed on a lower surface of the first polyethylene terephthalate membrane. Additionally, a second polyurethane paste with a second polyethylene terephthalate membrane is further applied on the first polyethylene terephthalate membrane. The polishing pad is further secured to a polishing platen with the second polyurethane paste.

Wet peeling Assay: The polishing pads were soaked in water, an acid solution of pH 2 and a base solution of pH 12, for 24 hours. Ply adhesion was measured by observing average values between 3 cm to 13 cm with a speed of 100 mm/min.

Dry peeling Assay: Ply adhesion was measured by observing average values between 3 cm to 13 cm with a speed of 100 mm/min.

The results are shown in Table 1:

TABLE 1

| Condition | Dry | Wet | Acid | Base |
|---|---|---|---|---|
| Adhesion strength between the polyethylene terephthalate membrane and the base material | | | | |
| Pad 1 | 1.4 | 1.3 | 0.4 | 0.4 |
| Pad 2 | 1.6 | 1.5 | 1.1 | 1.1 |
| Adhesion strength between the polyethylene terephthalate membrane and the polishing platen | | | | |
| Pad 1 | 0.7 | 0.5 | 0.5 | 0.5 |
| Pad 2 | 0.9 | 0.8 | 0.8 | 0.9 |

While embodiments of the present invention have been illustrated and described, various modifications and improvements can be made by persons skilled in the art. The embodiments of the present invention are therefore described in an illustrative but not restrictive sense. It is intended that the present invention is not limited to the particular forms as illustrated, and that all the modifications not departing from the spirit and scope of the present invention are within the scope as defined in the appended claims.

What is claimed is:

1. A polishing pad comprising:

a base material comprising fibers;

a membrane with low permeability, the membrane having an upper surface and a lower surface;

a two-component paste formed on the upper surface of the membrane with low permeability, for adhering the base material to the membrane with low permeability; and a polyurethane paste formed on the lower surface of the membrane with low permeability.

2. The polishing pad according to claim 1, wherein the material of the membrane with low permeability is selected from the group consisting of polyethylene terephthalate (PET), polypropylene (PP), polyethylene (PE), and a mixture thereof.

3. The polishing pad according to claim 2, wherein the polypropylene is oriented polypropylene (OPP).

4. The polishing pad according to claim 1, wherein the two-component paste comprises a polyol resin and polyisocyanate.

5. The polishing pad according to claim 4, wherein the polyol resin comprises polyurethane.

6. The polishing pad according to claim 1, wherein the two-component paste is embedded into the fibers of the base material.

7. The polishing pad according to claim 1, wherein the two-component paste is pH resistant in a pH range from about 2 to about 13.

8. The polishing pad according to claim 1, wherein the two-component paste is temperature resistant in a temperature range from about 10° C. to about 200° C.

9. The polishing pad according to claim 1, wherein an adhesion strength between the base material and the membrane with low permeability provided by the two-component paste is stronger than an adhesion strength between the membrane with low permeability and a polishing platen or head of a polishing machine provided by the polyurethane paste.

10. The polishing pad according to claim 1 further comprising a second membrane with low permeability formed below the polyurethane paste.

11. The polishing pad according to claim 10, wherein the material of the second membrane with low permeability is selected from the group consisting of polyethylene terephthalate, polypropylene, polyethylene, and a mixture thereof.

12. The polishing pad according to claim 10 further comprising the second paste formed below the second membrane with low permeability.

13. The polishing pad according to claim 12, wherein the second paste comprises polyurethane.

14. The polishing pad according to claim 1 further comprising a polishing layer on the base material comprising a porous elastomer.

15. The polishing pad according to claim 14, wherein the elastomer is polyurethane.

16. A method of polishing a substrate comprising using the polishing pad according to claim 1 to polish a surface of the substrate.

* * * * *